United States Patent [19]

Cunningham

[11] Patent Number: 4,802,875

[45] Date of Patent: Feb. 7, 1989

[54] TETHERED FLYING DISC WITH TWO-PIECE BEARING MEANS

[76] Inventor: Paul E. Cunningham, 4237 Henning Dr., Concord, Calif. 94521

[21] Appl. No.: 22,656

[22] Filed: Mar. 6, 1987

[51] Int. Cl.[4] ..... A63H 27/00

[52] U.S. Cl. ..... 446/46; 446/30; 446/228; 446/452; 273/414

[58] Field of Search ..... 446/30, 34, 46, 228, 446/452, 412; 273/414, 424

[56] References Cited

U.S. PATENT DOCUMENTS

| | | | |
|---|---|---|---|
| 480,619 | 8/1892 | Park | 446/452 |
| 707,577 | 8/1902 | Fox et al. | 446/452 |
| 2,613,476 | 10/1952 | Metz | 446/452 |
| 3,359,678 | 12/1967 | Headrick | 446/46 |
| 3,673,731 | 7/1972 | Farhi et al. | 446/46 |
| 3,673,732 | 7/1972 | Liotta | 446/46 |
| 3,814,427 | 6/1974 | Pahr | 273/414 |
| 3,863,385 | 2/1975 | Becker | 446/228 |
| 3,893,256 | 7/1975 | Wolf et al. | 446/228 |
| 3,976,297 | 8/1976 | Seymour | 446/30 |
| 4,040,625 | 8/1977 | Malafronte | 446/46 |
| 4,067,569 | 1/1978 | Palumbo | 273/414 X |
| 4,209,936 | 7/1980 | Sklar | 446/46 |
| 4,516,946 | 5/1985 | Rodarte | 446/46 |
| 4,664,389 | 5/1987 | Barclay et al. | 446/228 |
| 4,681,553 | 7/1987 | Rodarte | 446/46 |

FOREIGN PATENT DOCUMENTS

| | | | |
|---|---|---|---|
| 820412 | 9/1951 | Fed. Rep. of Germany | 446/30 |
| 1139060 | 10/1962 | Fed. Rep. of Germany | 446/30 |
| 1194630 | 11/1959 | France | 446/30 |
| 112507 | 12/1925 | Switzerland | 446/452 |
| 132165 | 9/1919 | United Kingdom | 446/452 |

*Primary Examiner*—Robert A. Hafer
*Assistant Examiner*—Charles H. Harris
*Attorney, Agent, or Firm*—Schapp and Hatch

[57] ABSTRACT

A tethered flying disc toy having a conventional inverted saucer body and an elongated flexible tether attached to the body by an annular ball bearing providing full freedom of rotation of the disc relative to the tether. In another form, the tether line slides through a bore in an upwardly projecting shank of a plug inserted into the inner race of a ball bearing having an axis of rotation coincident with the axis of rotation of the disc body so that the disc can move freely along the tether line while spinning.

7 Claims, 1 Drawing Sheet

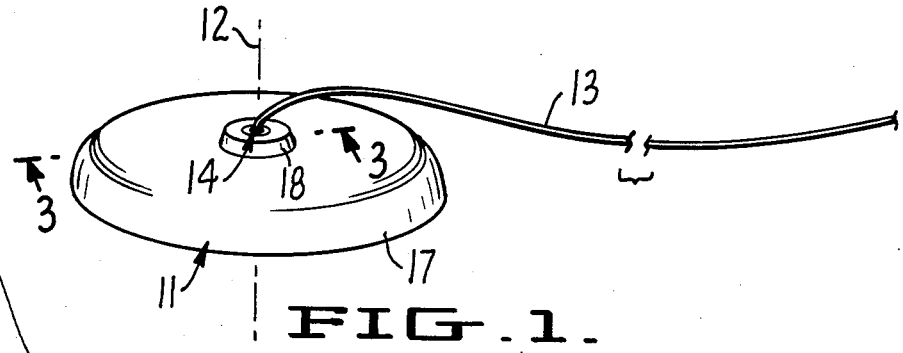
FIG. 1.
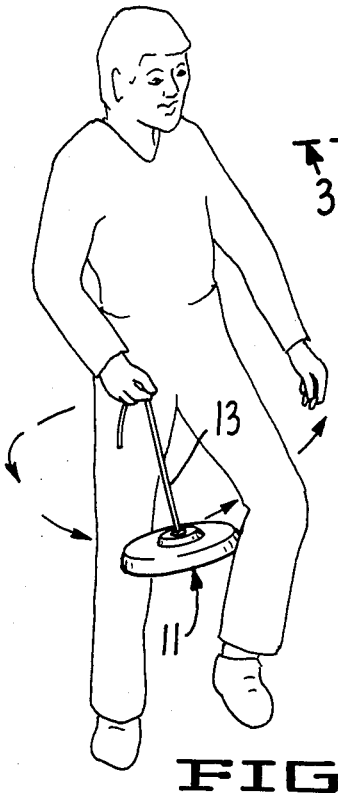
FIG. 2.
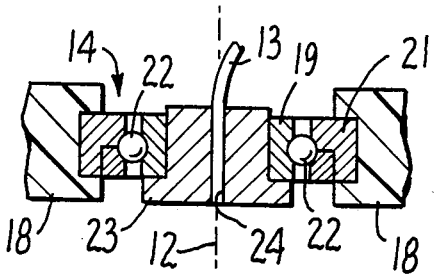
FIG. 4.
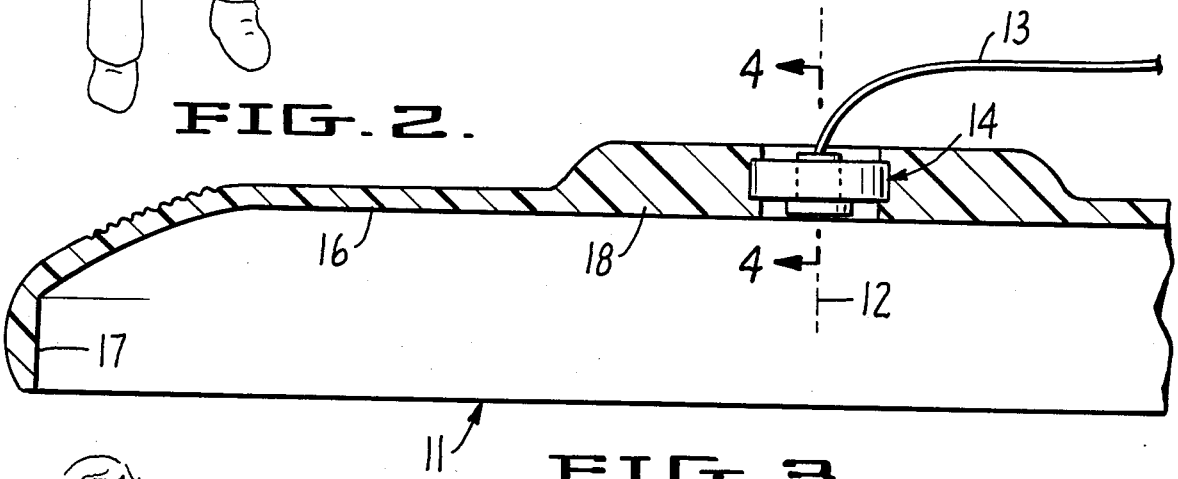
FIG. 3.
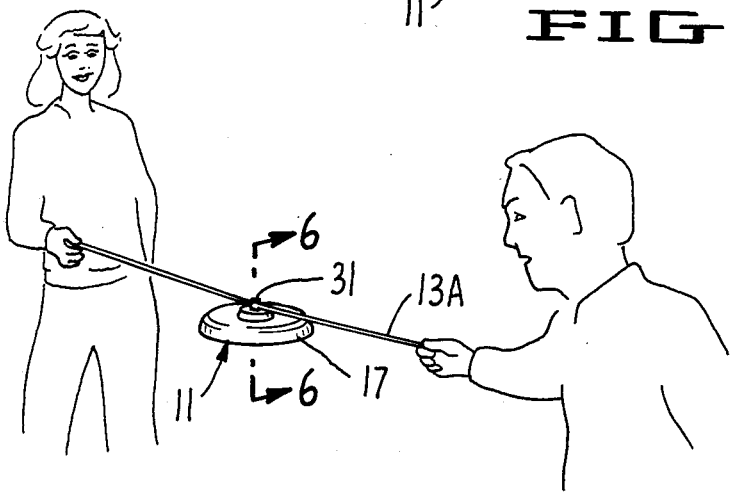
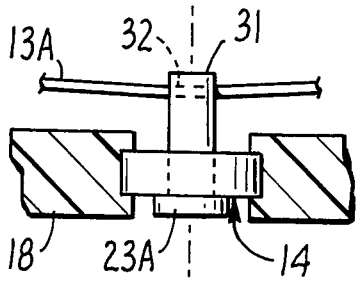
FIG. 6.
FIG. 5.

TETHERED FLYING DISC WITH TWO-PIECE BEARING MEANS

BACKGROUND OF THE INVENTION

1. Field of the Invention.

This invention relates to flying saucer or disc toys, and more particularly to flying disc toys having a manually engagable tether attached thereto for varying and controlling the flight path of the flying disc.

2. Description of the Prior Art.

During the last twenty-five years or so, aerodynamic toys to be thrown through the air, particularly flying saucers for use in throwing games, have become very popular For example, U.S. Pat. No. 3,359,678 to Edward E. Headrick, issued Dec. 26, 1967 shows a particular design of flying saucer having extremely good flying characteristics when launched by hand. Once the flying saucer is launched, however, it is no longer possible to control or vary the flight path. This limits the modes of play and accordingly reduces the desirability of owning such a device.

Attempts have been made to control the flight of the flying saucer (or "flying disc" as the device is more popularly known by providing a tether in the form of a nylon line having a loop in one end engagable through a central opening in the flying disc. The tethered disc concept is shown in U.S. Pat. No. 3,976,295 issued Aug. 24, 1976 to William D. Seymour. This tethered structure is limited in what can be done to control the flight path, mainly by limiting the length of the flight away from the operator before reversing the direction of flight back to the operator. The Seymour structure also facilitates retrieving the disc if it does not make it back to the operator in the course of its flight.

U.S. Pat. No. 4,516,946, issued May 14, 1985 to Michael R. Rodarte shows a flying disc construction having an annular roller bearing at its center, with the axis of rotation of the roller bearing coincident with the axis of rotation of the disc body. This is supposed to make it possible for the user to spin the device on an upwardly pointed finger, with the bearing acting to reduce friction between the finger and the spinning disc. Rodarte does not show nor suggest the use of a tether.

The term "prior art" as used herein or in any statement made by or on behalf of the application means *only* that any document or thing referred to as prior art bears, directly or inferentially, a date which is earlier than the effective date of this application.

SUMMARY OF THE INVENTION

The present invention provides a smooth working tethered flying disc capable of being controlled by the user or users in a variety of modes not previously available. To accomplish this, the tether is joined to the flying disc by an annular bearing having its center of rotation coincident with the center of rotation of the disc. This avoids unnecessary rubbing of the tether line against the disc, as is the case when the tether line is secured to the disc by a loop passing through the center of the disc. This increases controllability and avoids unwanted deflection of the disc by unwanted engagement with the tether line.

In one form of the invention, the tether line is secured to a plug mounted through the ball bearing in such manner that the end of the tether line lays on the center of rotation of the flying disc body. In this mode, the flying disc may be supported by the tether while spinning to perform maneuvers such as that illustrated in FIG. 2 of the drawings, as well as various other maneuvers such as those set forth in U.S. Pat. No. 3,976,297.

In a second form of the invention, the central plug is extended vertically upwardly and is provided with a transverse bore through which the tether line may slide. This permits maneuvers of the type suggested in FIG. 5 of the drawings wherein the opposite ends of the tether line can be grasped by two users, or by the left hand and right hand of a single user, and the flight of the disc can be directed and controlled by reason of its moving along the tether line.

It is therefore a principal object of the present invention to provide a flying disc toy having a bearing connection to an elongated flexible tether in such manner as to facilitate control over the flight path of the disc.

A further object of the present invention is to provide a flying disc toy of the character described in which the bearing connection between the tether line and the body of the disc aligns the end of the tether line with the axis of rotation of the disc for performing suspended maneuvers and for using the tether line to catch the disc at any desired point along its flight path.

A still further obeect of the present invention is to provide a flying disc toy of the character described which, in an alternate form, is capable of traveling along a tether line for controlling the flight path of the disc.

Other objects and features of advantage will become apparent as the specification progresses and from the claims.

BRIEF DESCRIPTION OF THE DRAWINGS

FIG. 1 is a perspective view of a tether flying disc toy constructed in accordance with the present invention.

FIG. 2 is a perspective view of the flying disc toy of FIG. 1 illustrating one of its modes of use by an operator.

FIG. 3 is an enlarged cross-sectional view taken substantially on the plane of Line 3—3 of FIG. 1.

FIG. 4 is a further enlarged cross-sectional view taken substantially on the plane of Line 4—4 of FIG. 3.

FIG. 5 is a perspective view of a modified form of the invention illustrating a mode of use in which the tether line directs the flight of the disc between two persons.

FIG. 6 is a vertical cross-sectional view on an enlarged scale taken substantially on the plane of Line 6—6 of FIG. 5.

While only the preferred forms of the invention are illustrated in the drawings, it will be apparent that various modifications could be made without departing from the ambit of the claims.

DESCRIPTION OF THE PREFERRED EMBODIMENTS

As may be seen in the accompanying drawings, the tethered flying disc toy of the present invention utilizes a body 11 of an inverted saucer shape having an axis of rotation 12, an elongated flexible tether 13 for controlling the body 11, and bearing means 14 joining the tether 13 to the body 11 for rotation independent of each other. Preferably, and as here shown, the body 11 is in the form of a concavo-convex wall 16 having a depending peripheral skirt 17, the wall 16 being thickened at its central portion 18 for holding the bearing means 14.

The bearing means 14 should be capable of providing essentially friction-free relative movement between the body 11 and the tether 13 and should be annular in form. Because of the outdoor and sandy beach environment in which flying discs are often used, the bearing means 14 should be relatively selfcleaning. For this purpose, there is here illustrated an annular ball bearing having considerable space between the inner race 19 and the outer race 21. Any debris entering between the inner and outer races and encountering the balls 22 can easily fall through the annular space between the races and out of the bearing.

As may best be seen in FIGS. 3 and 4 of the drawings, the bearing means 14 is of lesser height than the vertical thickness of the central portion 18 of the body 11. This eliminates protrusions which could otherwise accidentally be snagged by the tether line 13.

Preferably, tether line 13 is a monofilament line, which can be dyed with florescent dyes for visibility. Releasable attachment of the tether line 13 to the bearing means 14 is provided by a plug member 23 mounted in the inner race 19 of the bearing means 14. In the form of the invention illustrated in FIGS. 1 through 4 of the drawings, the plug 23 is provided with a vertical, central bore 24 in which the end of tether 13 is secured, as by cementing.

The tether line 13 may be of any suitable length for the particular maneuvers desired, and may be easily changed simply by snapping plug 23 out of inner race 19 and replacing it with another plug having a tether cord of different length or other characteristics.

In the form of the invention illustrated in FIGS. 5 and 6 of the drawings, like numbers are used on parts similar to those in the form of the invention illustrated in FIGS. 1 through 4 of the drawings. Plug 23, however, is replaced by a plug 23A which is similar to plug 23, but which has a shank 31 extending upwardly above the upper surface of the thickened central portion 18 of the upper wall 16 of the body 11. A transverse bore 32 is provided in shank 31 near its upper end and is proportioned to slidably receive a tether line **13*a*. The bearing means 14 makes it possible for the flying disc to rotate relative to the tether 13A, thus making it possible to direct the flight path of the disc 11 along the tether 13A in the manner illustrated in FIG. 5** of the drawings.

From the foregoing, it will be apparent that the tethered flying disc toy of the present invention incorporates novel structure making it possible to control the flight path of the flying disc in a variety of ways not hitherto available.

What I claim is:

1. A flying disc toy, comprising a body of inverted concavo-convex disc shape having an axis of rotation, an elongated flexible tether having two ends for controlling said body, and two-piece bearing means operatively connecting said tether to said body on said axis of rotation for free spinning rotation of said body independent of said tether, wherein a removable plug is inserted in said two piece bearing means, and said elongated flexible tether is engaged with said plug.

2. A flying disc toy as described in claim 1, and wherein said body is in the form of a concavo-convex wall having a depending peripheral skirt, and said wall is thickened at the central portion thereof for holding said bearing means.

3. A flying disc toy as described in claim 2, and wherein said bearing means comprises an annular bearing with relatively rotatable inner and outer races having an axis of rotation coincident with said axis of rotation of said disc.

4. A flying disc toy as described in claim 3, and wherein said bearing means comprises an annular multiple ball bearing.

5. A flying disc toy as described in claim 4, and wherein said annular ball bearing has a height less than the vertical thickness of said central portion of said body.

6. A flying disc toy as described in claim 1, and wherein one end of said elongated flexible tether is secured within a bore in said plug along the axis of rotation of said body for free spinning rotation with respect to said body, and the other end of said tether is manually graspable for controlling flight of said body.

7. A flying disc toy as described in claim 1, and wherein said plug extends vertically above said body, and said elongated flexible tether is slidably engaged in a horizontal bore above the upper surface of said body with both ends free for manual grasping.

* * * * *